US007264059B2

(12) United States Patent
Akselberg

(10) Patent No.: US 7,264,059 B2
(45) Date of Patent: Sep. 4, 2007

(54) METHOD AND DEVICE FOR PRESSURE CONTROLLED SEQUENTIAL OPERATION

(75) Inventor: Frank Akselberg, Sandnes (NO)

(73) Assignee: Bakke Oil Tools, AS, Algard (NO)

( * ) Notice: Subject to any disclaimer, the term of this patent is extended or adjusted under 35 U.S.C. 154(b) by 249 days.

(21) Appl. No.: 10/738,366

(22) Filed: Dec. 17, 2003

(65) Prior Publication Data

US 2004/0149448 A1 Aug. 5, 2004

(30) Foreign Application Priority Data

Dec. 23, 2002 (NO) ..... 20026182

(51) Int. Cl.
*E21B 34/06* (2006.01)

(52) U.S. Cl. ..... 166/373; 166/319; 166/381; 166/320; 166/386; 91/29

(58) Field of Classification Search ..... 166/373, 166/319, 381, 320, 386; 91/28, 29, 530; 92/152
See application file for complete search history.

(56) References Cited

U.S. PATENT DOCUMENTS

| | | | | |
|---|---|---|---|---|
| 2,979,904 | A * | 4/1961 | Royer | 92/152 |
| 3,952,763 | A | 4/1976 | Baugh | |
| 4,036,247 | A | 7/1977 | Baugh | |
| 4,407,183 | A | 10/1983 | Milberger et al. | |
| 4,796,699 | A * | 1/1989 | Upchurch | 166/319 |
| 5,101,907 | A * | 4/1992 | Schultz et al. | 166/319 |
| 6,179,052 | B1 | 1/2001 | Purkis et al. | 166/53 |
| 6,247,536 | B1 * | 6/2001 | Leismer et al. | 166/320 |
| 6,302,216 | B1 * | 10/2001 | Patel | 166/386 |
| 6,354,374 | B1 | 3/2002 | Edwards et al. | 166/297 |
| 6,651,749 | B1 * | 11/2003 | Kilgore | 166/381 |
| 7,000,705 | B2 * | 2/2006 | Buyers et al. | 166/386 |
| 7,013,980 | B2 * | 3/2006 | Purkis et al. | 166/386 |

FOREIGN PATENT DOCUMENTS

| | | |
|---|---|---|
| EP | 1 138 872 | 10/2001 |
| GB | 1 505 496 | 3/1978 |

OTHER PUBLICATIONS

U.K. Search Report, Application No. GB 0328589.7, dated Apr. 20, 2004.

* cited by examiner

*Primary Examiner*—Lanna Mai
*Assistant Examiner*—Matthew J. Smith
(74) *Attorney, Agent, or Firm*—Patterson & Sheridan, L.L.P.

(57) ABSTRACT

A method and a device for controlling a downhole hydraulic sequential control system (1) in which a number of pressure relief valves (20, 22) are arranged to open sequentially directly or indirectly for corresponding actuators (26, 34) through introduction of a hydraulic fluid, wherein the pressure of working fluid supplied to the control system is transmitted to hydraulic fluid in the control system (1). The pressure transfer may be effected by means of a dividing piston (6).

14 Claims, 1 Drawing Sheet

METHOD AND DEVICE FOR PRESSURE CONTROLLED SEQUENTIAL OPERATION

CROSS-REFERENCE TO RELATED APPLICATIONS

This application claims benefit of Norwegian provisional patent application number 2002 6182, filed Dec. 23, 2002, which is herein incorporated by reference.

BACKGROUND OF THE INVENTION

1. Field of the Invention

This invention regards a method of pressure controlled sequential operation. More particularly, it concerns a method of controlling a sequence of operations in a downhole tool. The invention also comprises a device for implementing the method.

2. Description of the Related Art

When working under ground, e.g. in a borehole, it is vital that the order of a sequence of individual operations may be controlled in a reliable manner.

It is known to use telemetry and rotational frequencies to communicate from the surface and down to the downhole tool in, for example, a pipe string. The use of electrical signals for such communication is also known.

These forms of communication have shortcomings that to a considerable extent reduce their applicability, as telemetry requires the use of relatively sensitive instrumentation, and the use of rotational frequencies is dependent on the downhole tool being rotatable. Electrical conductors are often exposed to damage.

Thus it has become more common to control tools through variation of the working fluid pressure, for example during coiled tubing operations, where a relative increase in the pressure of the working fluid may be used to initiate an additional operation.

For complex operations that require the use of a large number of relatively sensitive valves, and where the pressure interval between the opening of one valve in the sequence and the opening of the next is small, it has been found that, due to a reduced operational safety in the valve system, working fluid is unsuited for use in valves of this type.

A further adverse effect of pressure controlled sequential operation is that the remaining tool functions, where use is made of e.g. hydraulic cylinders, are often influenced by pressure variations in the working fluid. Moreover, it has been found that the maximum pressure of the working fluid is often too low to allow the execution of certain operations connected with a downhole tool.

The object of the invention is to remedy these disadvantages.

SUMMARY OF THE INVENTION

The object is achieved in accordance with the invention, by the characteristics given in the following claims.

At least in preferred embodiments, working fluid supplied to a downhole tool from the surface, for example through coiled tubing, is fed to a fluid separator, preferably in the form of a booster. The fluid separator typically comprises a separating piston running in a cylinder, pressure from the working fluid being applied to one side of the piston, while the opposite side of the piston can apply pressure to a hydraulic fluid.

By providing the piston with two different piston areas, the input and output pressures from the fluid separator may be different. If the working pressure acts on a piston area twice the size of the piston area acting on the hydraulic fluid, the hydraulic fluid pressure will be twice the working fluid pressure. Fluid separators of this type are called boosters.

From the fluid separator, the hydraulic fluid flows to a first pressure relief valve set to open at a first pressure. Advantageously, a hydraulic accumulator is also linked to this connection in order to buffer pressure surges and pressure variations in the control system.

A first operation is initiated when the pressure of the hydraulic fluid reaches a first pressure. A second pressure relief valve is set to open at a second pressure that is higher than the first pressure. Upon reaching the second pressure, a second operation is initiated, e.g. through the opening of a pilot controlled check valve.

The control system may be provided with as many pressure control valves with different set pressures as is necessary to control the tool actuators.

In a preferred embodiment, the working fluid side of the fluid separator is provided with a throttle valve in a bleed port. The pressure drop across the throttle valve is dependent on the flow rate through the throttle valve.

Thus the working fluid pressure acting on the dividing piston is controlled by the flow rate of the working fluid. The sequence of the control system may thereby be controlled by regulating the volume rate of working fluid being pumped to the downhole tool at all times.

The method of the invention allows the hydraulic control system to work with a clean hydraulic fluid that may have a higher maximum pressure than the working fluid, whereby the functional reliability is greatly improved, especially during operations that call for multiple sequences.

BRIEF DESCRIPTION OF THE DRAWING

The following gives a description of a non-limiting example of a preferred method and embodiment illustrated in the accompanying drawing, in which.

DETAILED DESCRIPTION OF THE PREFERRED EMBODIMENT

Figure 1:
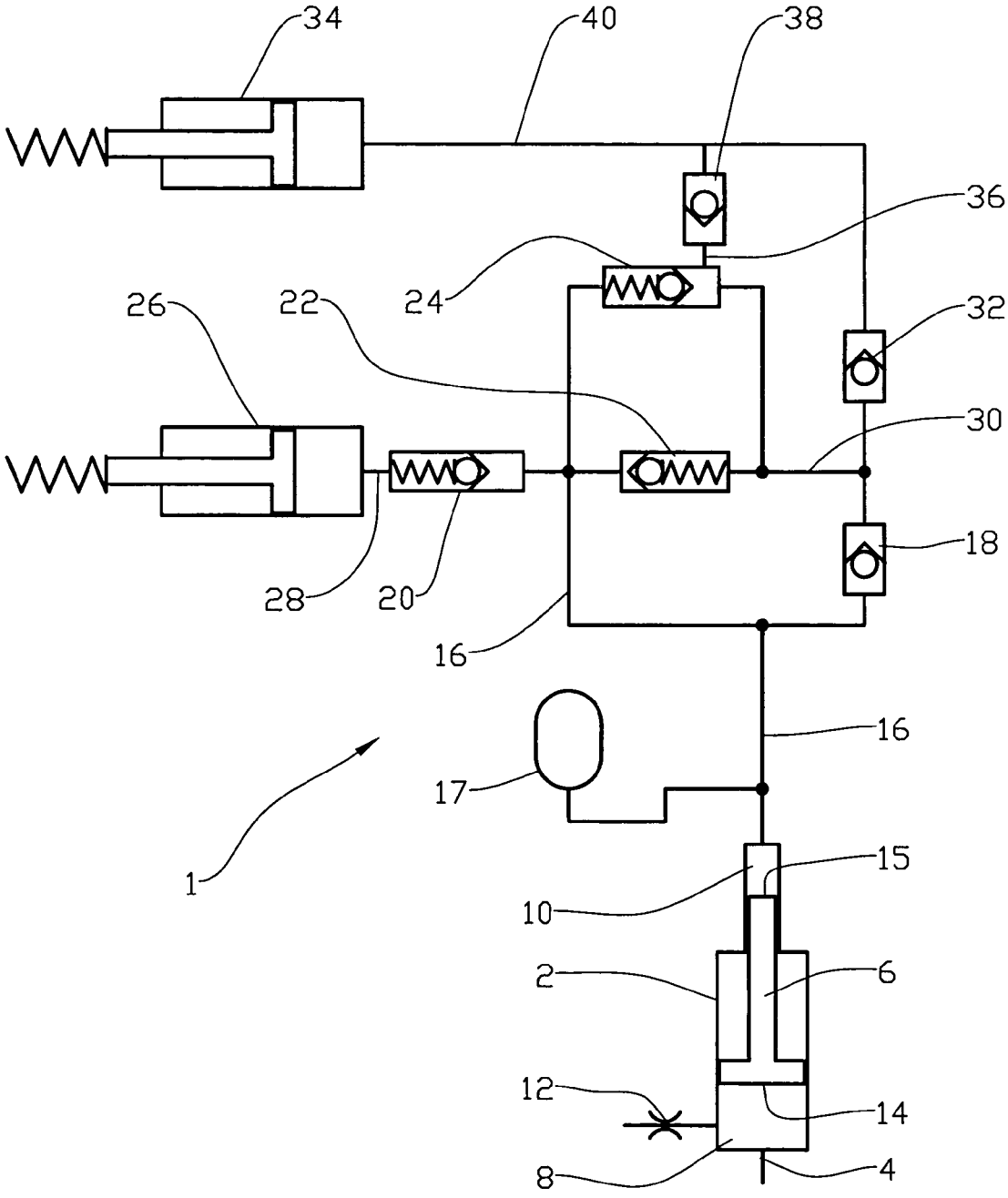
FIG. 1 shows a simplified circuit diagram of the downhole tool control system.

In FIG. 1, reference number 1 denotes a hydraulic sequential control system for a downhole tool (not shown).

Working fluid may flow from e.g. coiled tubing (not shown) and through an inlet port 4 into a booster 2. A piston 6 in the booster 2 sealingly separates a working fluid chamber 8 and hydraulic fluid chamber 10 of the booster 2.

A throttle valve 12 communicates with the working fluid chamber 8 and is arranged to throttle an outlet from the working fluid chamber 8.

Preferably the piston 6 is designed so that the working fluid acts on a piston area 14, which is larger than a piston area 15 acting on the hydraulic fluid.

From the hydraulic fluid chamber 10, hydraulic fluid flows via a first distribution line 16 to an accumulator 17, the closing port of a first check valve 18, a first pressure relief valve 20, a second pressure relief valve 22 and the inlet port of a controlled pilot valve 24. The first pressure relief valve 20, which is arranged to open at a first predetermined pressure, is connected to a first actuator 26 via a pipe 28.

The hydraulic accumulator 17 is connected to the system mainly to buffer pressure surges and pressure variations in the control system.

A second distribution line 30 communicates with the second pressure relief valve 22, which is arranged to open the pilot port of the pilot valve 24, the opening port of the first check valve 18 and the closing port of a second check valve 32 at a second predetermined pressure.

The outlet port of the pilot valve 24 communicates with a second actuator 34 via a pipe 36, a third check valve 38 and a third distribution line 40. The third distribution line 40 also communicates with the opening port of the second check valve 32.

When the hydraulic sequential control system 1 is to be started up, working fluid flows into the working fluid chamber 8 of the booster 2, where it exerts a pressure on the relatively large piston area 14 of the piston 6. The relatively smaller piston area 15 acts on the hydraulic fluid in the hydraulic fluid chamber 10, the pressure in the hydraulic fluid chamber 10 being greater than the pressure in the working fluid chamber 8 at a ratio corresponding to the relative areas of the piston areas 14 and 15.

Fluid is drained from the working fluid chamber 8 through the throttle valve 12.

The inflow rate of working fluid to the working fluid chamber 8 is increased sufficiently for the pressure in the hydraulic fluid to increase to the set pressure of the pressure relief valve 20, whereby the fluid flows via the pipe 28 to the first actuator 26. Fluid is prevented from flowing from the first distribution line 16 through the first check valve 18, the second pressure relief valve 22 and the pilot valve 24.

By further increasing the flow of working fluid the pressure in the first distribution line 16 rises to the set pressure of the second pressure relief valve 22. By so doing, fluid flows through the second pressure relief valve 22 via the second distribution line 30 to the pilot port of the pilot valve 24. Then pilot valve 24 then opens for flow of hydraulic fluid via the pipe 36, the third check valve 38 and the third distribution line 40 to the second actuator 34. Fluid can not flow from the third distribution line 40 via the second check valve 18, as the pressure of the first distribution line 16 is at least as great as in the third distribution line 40.

Reducing the inflow to the working fluid chamber 8 reduces the pressure of the hydraulic fluid, whereby the pressure relief valves 20 and 22 close. Fluid may flow from the second actuator 34 through the check valves 32 and 18 to the hydraulic fluid chamber 10. The first actuator 26 is drained by a valve (not shown).

The control sequence can then be repeated.

Advantageously the method and device of the invention can be expanded according to the above principles in order to provide sequential control of more than two actuators 26, 34.

The invention claimed is:

1. A method of controlling a downhole hydraulic sequential control system, comprising providing the control system at a downhole location, the control system comprising hydraulic fluid, a first pressure relief valve set to open at a first pressure, and a second pressure relief valve set to open at a second pressure, wherein the second pressure is greater than the first pressure; and transmitting pressure of downhole working fluid to the hydraulic fluid of the control system, wherein the pressure from the working fluid is transmitted to the hydraulic fluid by a booster.

2. A method as claimed in claim 1, wherein the pressure relief valves provide flow directly or indirectly to corresponding actuators.

3. A method as claimed in claim 1, wherein the pressure of the hydraulic fluid is controlled through regulating the flow rate of the working fluid, by draining the working fluid through a throttle valve with flow dependent flow resistance.

4. A method as claimed in claim 1, further comprising supplying the working fluid to the control system from the surface through coiled tubing.

5. A method as claimed in claim 1, wherein the pressure is created by throttling flow of the working fluid.

6. A downhole hydraulic sequential control system comprising a first pressure relief valve set to open at a first pressure;

a second pressure relief valve set to open at a second pressure, wherein the second pressure is greater than the first pressure; and a dividing piston arranged to be influenced by pressure of downhole working fluid and transmit pressure through hydraulic fluid to the pressure relief valves, wherein the dividing piston forms part of a booster.

7. A system as claimed in claim 6, further comprising a throttle valve communicatingly connected to a working fluid chamber of the dividing piston.

8. A system as claimed in claim 7, wherein the throttle valve as a flow dependent resistance.

9. A method of controlling a downhole hydraulic sequential control system in which a plurality of pressure relief valves are arranged to open sequentially by introduction of a hydraulic fluid, the method comprising transmitting pressure of downhole working fluid to the hydraulic fluid of the control system by a dividing piston, wherein an area of the dividing piston acted on by the working fluid is larger than an area of the piston acting on the hydraulic fluid so that the pressure of the hydraulic fluid is higher than the pressure of the working fluid.

10. A method of controlling a downhole hydraulic sequential control system, comprising providing the control system at a downhole location, the control system comprising hydraulic fluid, a first pressure relief valve set to open at a first pressure, and a second pressure relief valve set to open at a second pressure, wherein the second pressure is greater than the first pressure; and transmitting pressure of downhole working fluid to the hydraulic fluid of the control system, wherein pressure of the hydraulic fluid is controlled through regulating a flow rate of the working fluid, by draining the working fluid through a throttle valve with flow dependent flow resistance.

11. A method of controlling a downhole hydraulic sequential control system, comprising providing the control system at a downhole location, the control system comprising hydraulic fluid, a first pressure relief valve set to open at a first pressure, and a second pre sure relief valve set to open at a second pressure, wherein the second pressure is grater than the first pressure; and transmitting pressure of downhole working fluid to the hydraulic fluid of the control system, wherein the pressure from the working fluid is transmitted to the hydraulic fluid by a dividing piston, and an area of the dividing piston acted on by the working fluid is larger than an are of the piston acting on the hydraulic fluid so that the pressure of the hydraulic fluid is higher than the pressure of the working fluid.

12. A downhole hydraulic sequential control system comprising a first pressure relief valve set to open at a first pressure;

a second pressure relief valve set to open at a second pressure, wherein the second pressure is greater than the first pressure; and a dividing piston arranged to be influenced by pressure of downhole working fluid and transmit pressure through hydraulic fluid to the pressure relief valves, wherein an area of the dividing piston acted on by the working fluid is greater than an area of the dividing piston acting on the hydraulic fluid.

13. A method of controlling a downhole hydraulic sequential control system, comprising:

providing the control system at a downhole location, the control system comprising:

hydraulic fluid, a first pressure relief valve set to open at a first pressure, a second pressure relief valve set to open at a second pressure, wherein the second pressure is greater than the first pressure, and a piston disposed in a cylinder and isolating a working fluid from the hydraulic fluid, the piston having a first area in fluid communication with the working fluid and a second area in fluid communication with the hydraulic fluid, and the cylinder having a chamber, an inlet port, and an outlet port, and injecting the working fluid into the chamber via the inlet port, wherein the working fluid is throttled as the working fluid exits the chamber via the outlet port, thereby creating pressure in the chamber, exerting the pressure on the first area of the piston, and causing t e second area of the piston to act on the hydraulic fluid.

14. A method as claimed in claim 13, wherein the working fluid is injected into the chamber via coiled tubing from the surface.

* * * * *

UNITED STATES PATENT AND TRADEMARK OFFICE

CERTIFICATE OF CORRECTION

PATENT NO. : 7,264,059 B2
APPLICATION NO. : 10/738366
DATED : September 4, 2007
INVENTOR(S) : Akselberg It is certified that error appears in the above-identified patent and that said Letters Patent is hereby corrected as shown below:

Column 4, Claim 11, Line 54, please delete “pre sure” and insert --pressure--;

Column 4, Claim 11, Line 55, please delete “grater” and insert --greater--;

Column 4, Claim 11, Line 63, please delete “are” and insert --area--;

Column 6, Claim 13, Line 12, please delete “t e” and insert --the--.

Signed and Sealed this

Twenty-seventh Day of May, 2008

JON W. DUDAS
*Director of the United States Patent and Trademark Office*